US007600268B2

(12) United States Patent
Rogers et al.

(10) Patent No.: US 7,600,268 B2
(45) Date of Patent: Oct. 13, 2009

(54) HELMET RETENTION SYSTEM WITH IMPROVED STABILITY

(75) Inventors: David C. Rogers, Boston, MA (US); Edward R. Hall, Somerville, MA (US)

(73) Assignee: Artisent, Inc., Boston, MA (US)

( * ) Notice: Subject to any disclaimer, the term of this patent is extended or adjusted under 35 U.S.C. 154(b) by 0 days.

(21) Appl. No.: 11/701,653

(22) Filed: Feb. 2, 2007

(65) Prior Publication Data

US 2007/0192945 A1 Aug. 23, 2007

Related U.S. Application Data

(60) Provisional application No. 60/765,144, filed on Feb. 4, 2006, provisional application No. 60/842,074, filed on Sep. 1, 2006.

(51) Int. Cl.
*F41H 1/04* (2006.01)

(52) U.S. Cl. ..... 2/6.6; 24/265 BC

(58) Field of Classification Search ..... 2/410, 2/6.2, 6.6, 6.8, 411, 416, 417, 421, 425, 9; 24/265 BC, 614–616, 625
See application file for complete search history.

(56) References Cited

U.S. PATENT DOCUMENTS 4,044,400 A 8/1977 Lewicki et al.
4,335,472 A 6/1982 Rappleyea
4,398,306 A 8/1983 Gooding
4,569,106 A * 2/1986 Lovato ..... 24/615
4,646,368 A 3/1987 Infusino et al.
4,703,879 A 11/1987 Kastendieck et al.
4,741,054 A 5/1988 Mattes
4,753,378 A 6/1988 Kastendieck et al.
4,793,032 A 12/1988 Crowle
4,856,119 A 8/1989 Haberle et al.
4,897,888 A 2/1990 Broersma et al.
4,998,328 A * 3/1991 Tanaka ..... 24/639
5,007,141 A 4/1991 Gentes
5,077,839 A 1/1992 Keller
5,083,321 A 1/1992 Davidsson et al.
5,123,121 A 6/1992 Broersma
5,179,735 A 1/1993 Thomanek et al.
5,398,390 A 3/1995 Hede et al.
5,438,737 A 8/1995 Anscher et al.
D364,124 S 11/1995 Lortz et al.
5,469,583 A 11/1995 Akeley et al.
5,471,678 A 12/1995 Dor et al.
5,581,819 A 12/1996 Garneau et al.
5,608,918 A 3/1997 Salvaggio et al.
5,685,020 A 11/1997 Powell et al.
5,911,315 A * 6/1999 Flowers ..... 2/421
5,996,192 A * 12/1999 Haines et al. ..... 24/625
6,311,338 B1 * 11/2001 Galet ..... 2/421
6,463,638 B1 10/2002 Pontaoe
6,532,602 B2 3/2003 Watters et al.

(Continued)

*Primary Examiner*—Shaun R Hurley
*Assistant Examiner*—Andrew W Sutton
(74) *Attorney, Agent, or Firm*—Goodwin Procter LLP

(57) ABSTRACT

A mounting buckle for a safety helmet includes at least one mating member configured for attachment to a V-shaped strap having an apex, the apex of the strap being substantially flush with the abutment surface. This configuration channels the tension in the straps along continuous lines, rather than allowing the tension to dissipate in an intervening length of strap.

10 Claims, 7 Drawing Sheets

U.S. PATENT DOCUMENTS

| | | | | |
|---|---|---|---|---|
| D483,294 | S | 12/2003 | Uehara et al. | |
| D496,305 | S | 9/2004 | Anscher et al. | |
| 6,804,829 | B2 | 10/2004 | Crye et al. | |
| 6,854,133 | B2 | 2/2005 | Lee et al. | |
| D510,297 | S | 10/2005 | Funo et al. | |
| 2004/0003452 | A1 | 1/2004 | Schiebl | |
| 2005/0210567 | A1 | 9/2005 | Rogers et al. | |
| 2005/0241050 | A1 | 11/2005 | Pietrzak et al. | |
| 2006/0179537 | A1 * | 8/2006 | Dennis et al. | 2/6.6 |
| 2007/0089219 | A1 * | 4/2007 | Trainor et al. | 2/421 |

* cited by examiner

HELMET RETENTION SYSTEM WITH IMPROVED STABILITY

RELATED APPLICATION

The present application claims priority to, and the benefits of, U.S. Provisional Application Ser. Nos. 60/765,144, filed Feb. 4, 2006, and 60/842,074, filed on Sep. 1, 2006, the entire disclosures of which are hereby incorporated by reference.

FIELD OF THE INVENTION

This invention relates generally to safety helmets and, in particular, to helmet straps and their adjustment.

BACKGROUND OF THE INVENTION

Helmets for head protection are worn in a variety of environments and for various purposes. Helmets are often secured to a wearer's head by a flexible chin strap. The chin strap may include multiple segments of flexible strap material that are secured at either side of the helmet and pass below the chin, where the segments are releasably joined. In some helmets the strap segments on either side of the helmet are attached to the helmet at two positions, in front of and behind the wearer's ear. When joined, the two strap segments form a single strap that may be adjusted in length. Many of the available approaches to connecting the strap segments are cumbersome and lack security. In some cases, for example, the wearer must pass one end of the strap through a buckle or a pair of "D-rings" with a return loop, making it difficult to quickly remove the helmet in an emergency. In other cases, a quick release "snap" lacks security due to the possibility of accidental release. Two-finger release mechanisms, while more secure, typically attach to the ends of the strap segments and thus require intervening length in line with the straps. This makes it difficult to place the fastener near the chin, which can be important to the stability of the helmet.

Simplifying the strap arrangements may reduce the awkwardness of disengagement, but often at the price of reduced helmet stability. For example, single-strap systems may allow play in the helmet when worn. Indeed, even multiple-strap systems can allow helmet movement if the straps are not aligned so as to maintain consistent lines of tension.

SUMMARY OF THE INVENTION

The present invention provides practical and reliable solutions to the foregoing problems. In various embodiments, the invention provides a secure retention system for protective helmets that facilitates easy adjustment. In particular, the stability of a protective helmet is improved when the straps that connect to the helmet on each side have substantially straight, continuous lines of tension extending through the buckle that joins them. Accordingly, in preferred embodiments, two V-shaped strap segments are drawn into an "X" configuration that channels the tension in the straps along continuous lines, rather than allowing the tension to dissipate in an intervening length of strap.

For example, a releasable two-part buckle in accordance with the invention may comprise a male component attached at one end to a flexible strap segment and having at least two fingers extending from the other end of the component, which can snap-engage a female component. The engagement can be released by simultaneously pressing the two fingers. In a preferred embodiment, the female component has a pass-through area along its underside, parallel to the direction of introduction of the male component, through which a second flexible strap segment may be passed. Flush abutment between flat surfaces of the male and female components without significant intervening linear space helps maintain tension between the strap components.

In one embodiment, a system of flexible straps comprises a chin-holding component having one strap segment passing below the chin and another strap segment passing between the chin and the lower lip; retention components on left and right sides of the helmet having one strap segment connecting to the front portion of the helmet and another strap segment connecting to a rear portion of the helmet; and a connecting device of the present invention joining the chin-holding component to the retention component on one side of the wearer's head such that the strap segments intersect substantially in the shape of the letter "X".

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE PREFERRED EMBODIMENTS

Figure 1:
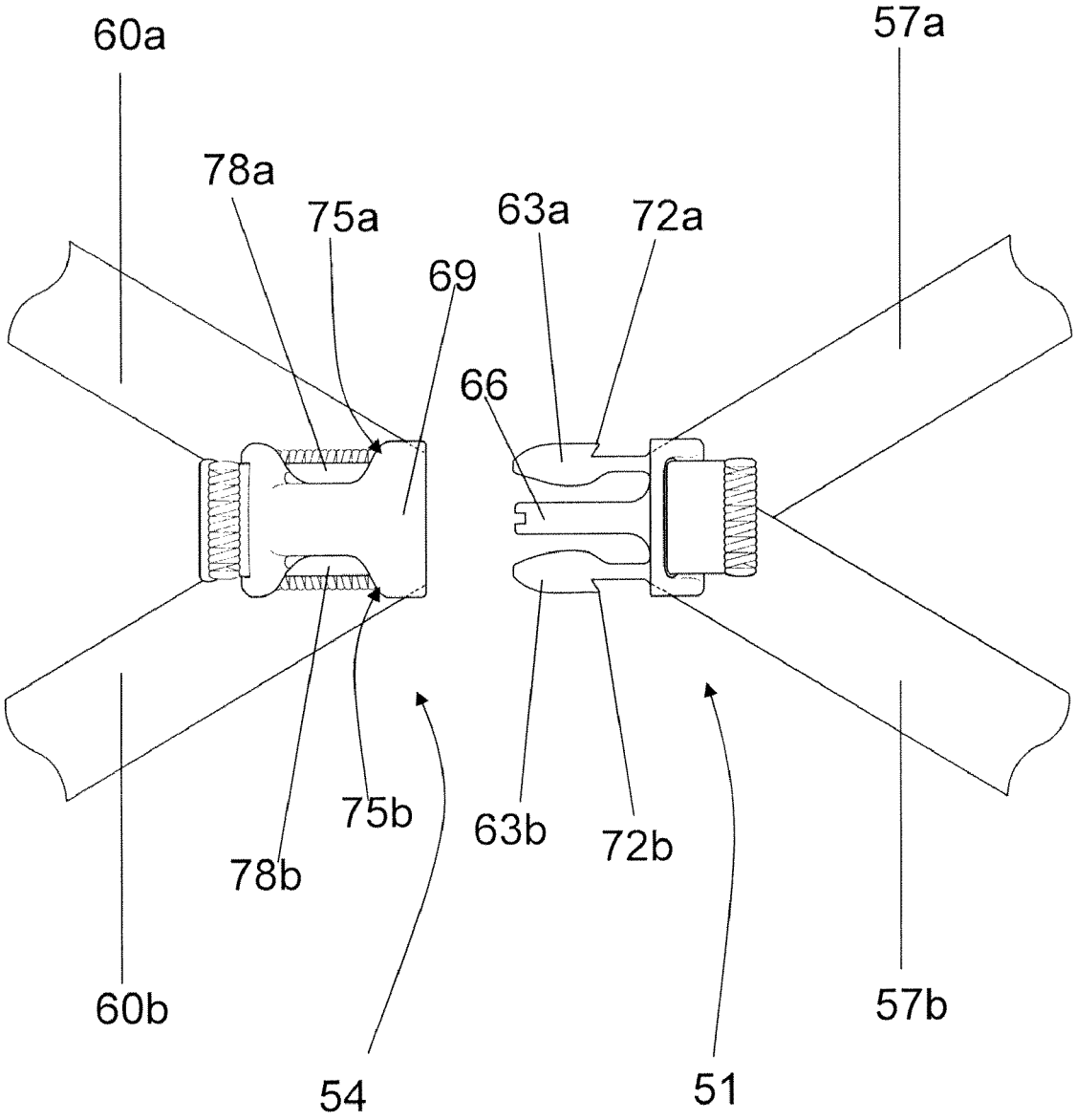
FIG. 1 is a plan view of the male and female components of a buckle in accordance with the present invention.

With reference to FIG. 1, a buckle in accordance with the present invention comprises a male component 51 and a female component 54 coupling together flexible straps comprising, with respect to male component 51, strap segments 57*a*, 57*b*, and with respect to female component 54, strap segments 60*a*, 60*b*. Male and female components 51, 54 are preferably molded from a strong, flexible, resilient plastic material such as Nylon or Delrin. The fingers 63*a*, 63*b* and guide member 66 are received within a receptacle area 69 of the female component 54 using normal manual pressure. During this coupling movement, fingers 63*a* and 63*b* deflect laterally toward guide member 66 until engaging features 72*a*, 72*b* have cleared surfaces 75*a*, 75*b* of the female component 54. At this point, the flexibility of the fingers 63*a*, 63*b* cause them to return outwardly to their uncompressed position, so that surfaces 75*a*, 75*b* resist return movement of engaging features 72*a*, 72*b*, thereby preventing separation of the male component 51 from the female component 54. The female component 54 has openings 78*a*, 78*b* that afford access to fingers 63*a*, 63*b* following insertion of the male component 51 into the female component 54.

Figure 2A:
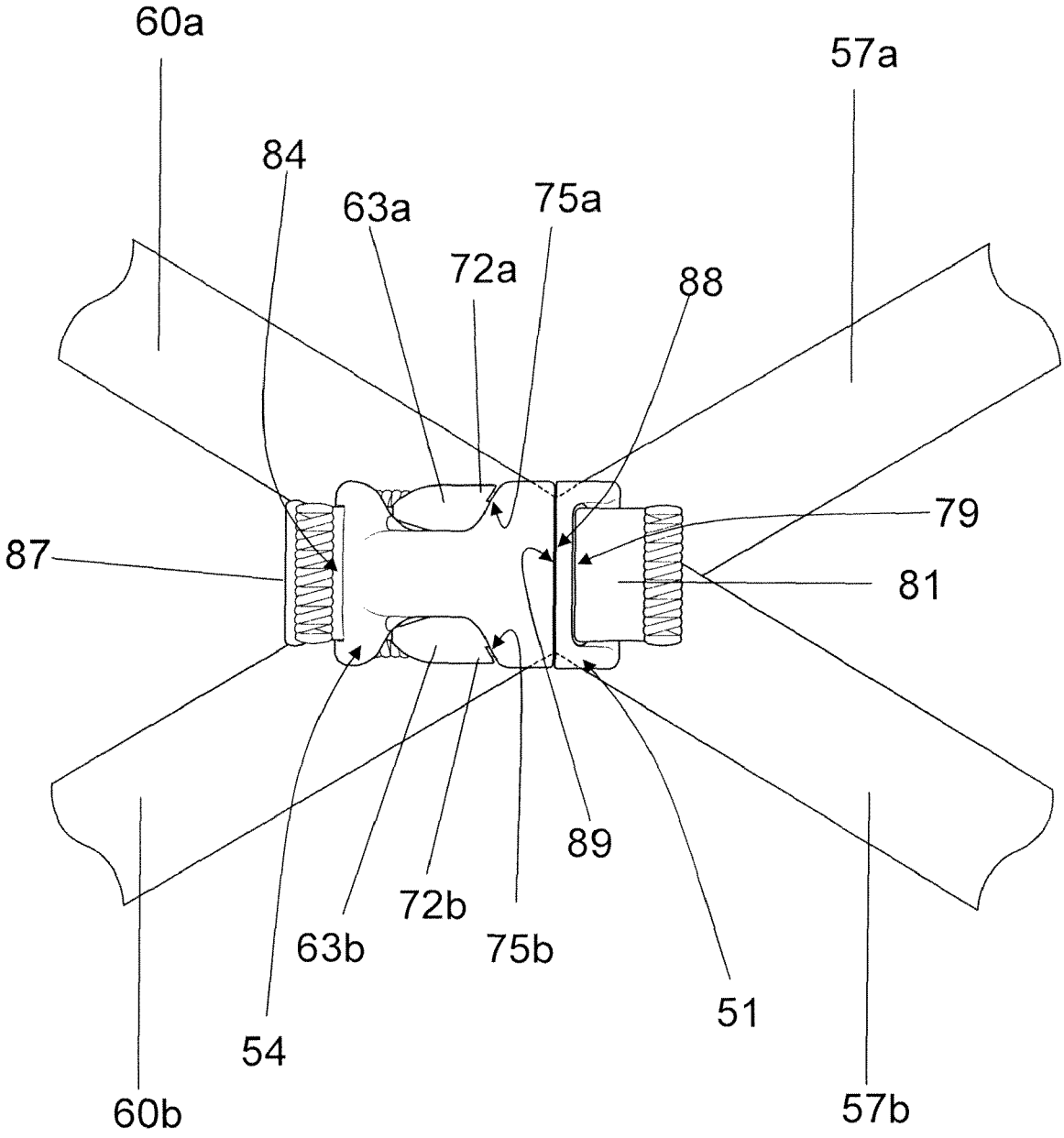
FIG. 2A is an upper plan view of the buckle of FIG. 1 in the connected position.
Figure 2B:
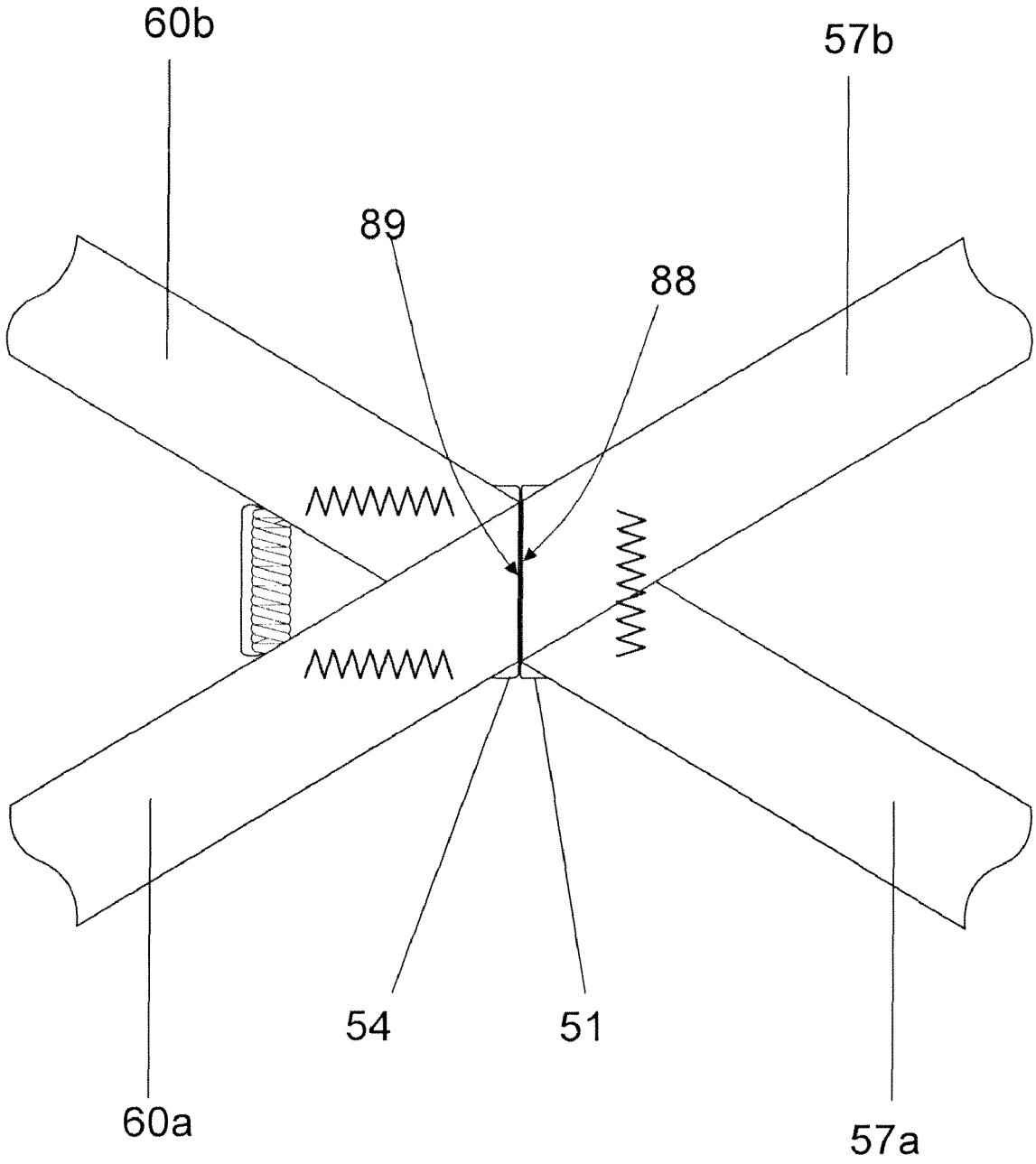
FIG. 2B is a lower plan view of the buckle of FIG. 2A.
Figure 3:
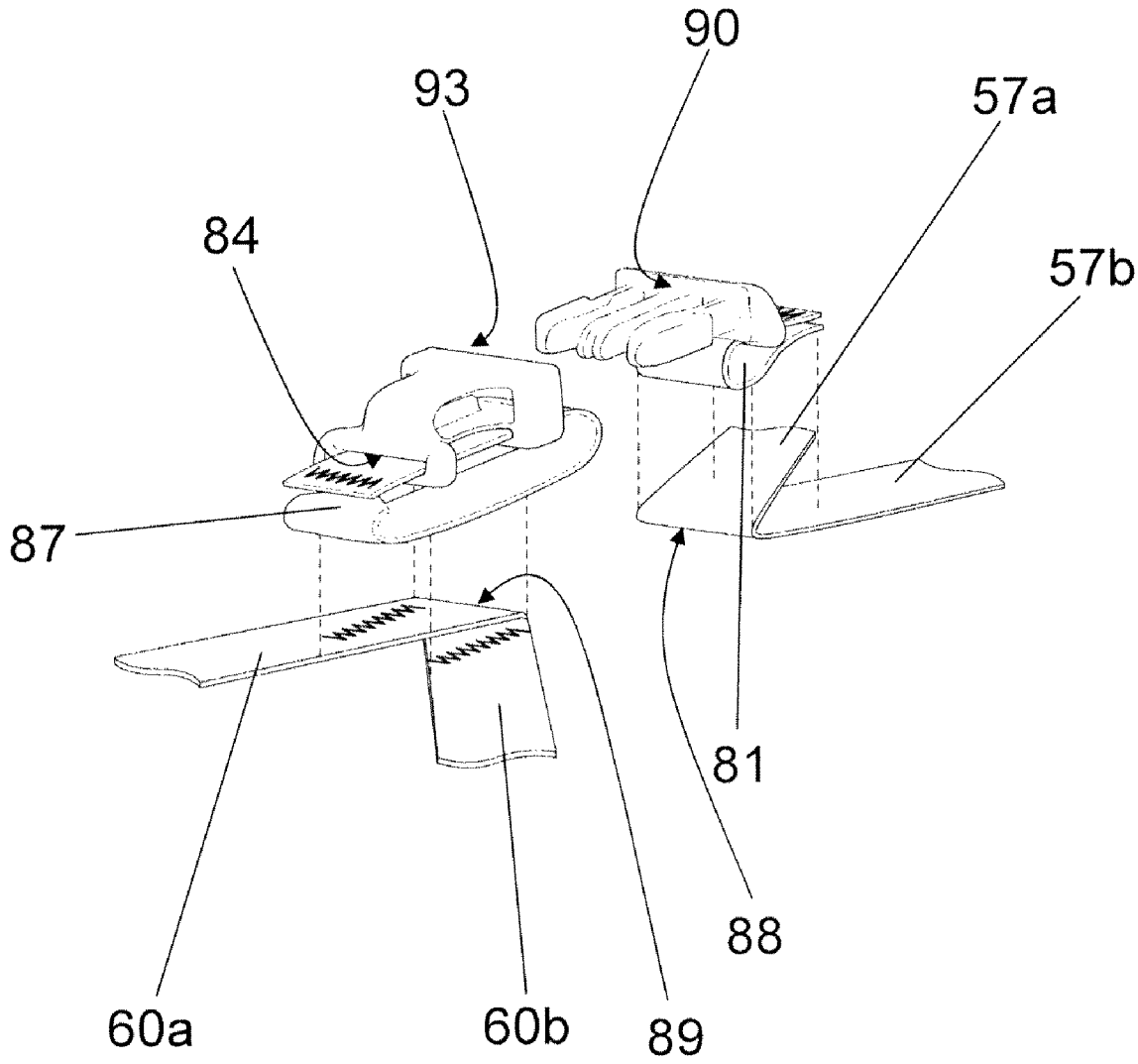
FIG. 3 is an exploded view of the buckle of the present invention showing the flexible straps to which the male and female components are to be connected.

With reference to FIGS. 2 and 3, fingers 63*a*, 63*b* are sufficiently exposed through the openings in the female component 54 to permit the wearer to pinch the fingers and flex them inwardly, thereby freeing the engaging features 72*a*, 72*b* from surfaces 75*a*, 75*b* and allowing the male component 51 to be withdrawn from the female component 54. A flexible intermediate strap 81 passes through a slot 79 in male component 51, and a flexible intermediate strap 87 is secured to female component 54 through a pass-through area 84.

In the preferred embodiment, intermediate strap 81 is sewn or otherwise permanently affixed to the flexible strap components 57*a*, 57*b*. As illustrated, the components 57*a*, 57*b* are part of the same single length of strap, which is folded to form a V-shaped configuration. Alternatively, however, components 57*a*, 57*b* can be separate strap segments that are joined to form the same configuration. In either case, the apex 88 of the V is substantially aligned (i.e., flush) with the abutment face 90 of male component 51, which, when the male and female components are locked, makes contact with a complementary abutment surface 93 of the female component 54. As a result, the edges of the V-shaped straps at their apices are substantially in contact along the entire apex 88 edge length.

Similarly, the pass-through area 84 in the female component accepts intermediate strap 87, which is sewn or otherwise affixed to strap segments 60*a*, 60*b* and positioned so that the apex 89 of the V is substantially flush with the abutment surface 93. The pass-through area 84 is oriented parallel to the direction of introduction of the male component 54, and locates the tensioning region of the strap segments 60*a*, 60*b* adjacent the front surface 93 of the female component 54, very close to the point where the female component joins the male component.

It is also possible to utilize the invention with single linear strap segments rather than V-shaped segments. In this case, the male component 51 may be connected to one of the single straps directly through the slot 79 (see FIG. 2) instead of employing the intermediate strap 81, and the female component 54 may be connected directly to the other single strap using the pass-through area 84, thereby obviating the need for the intermediate strap 87. Another alternative is to use one free, single strap and one V-shaped strap, in which case it is advantageous for the male component 51 to be connected to the single strap directly through the slot 79 and the female component 54 to be connected to the V-shaped strap via intermediate strap 87.

Figure 4:
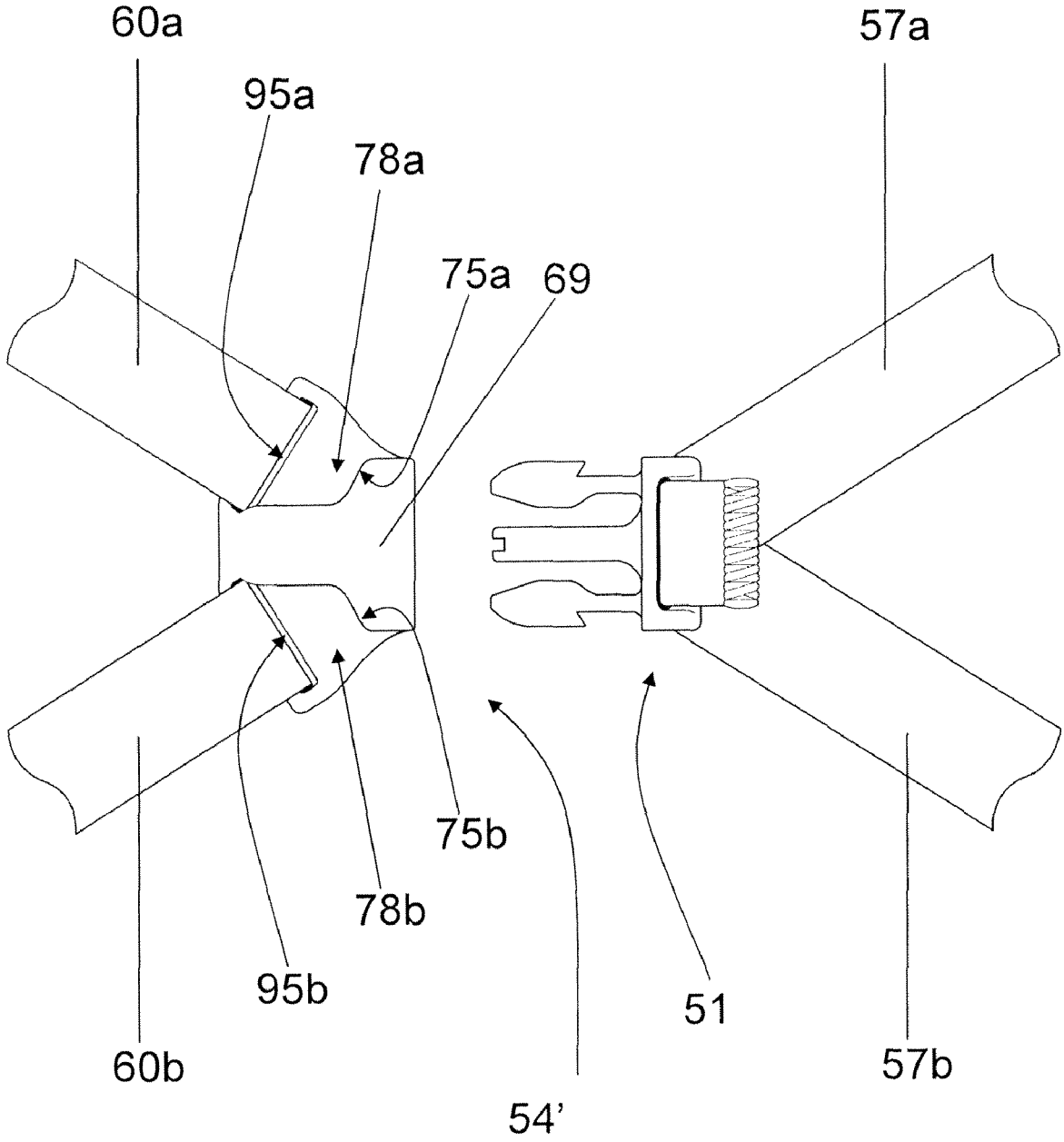
FIG. 4 shows another embodiment of the present invention in plan view.

FIG. 4 illustrates another embodiment 54' of the female component. The component 54' has many of the same features as the female component 54 shown in previous figures, including receptacle area 69, surfaces 75*a*, 75*b*, and openings 78*a*, 78*b* which cooperate with features of the male component 51 as described previously. Straps 60*a*, 60*b* are attached to the component 54' via mounts such as the slots 95*a*, 95*b*. This embodiment is particularly well suited to applications where two straps are joined at the female side with one or two straps on the male side.

Figure 5:
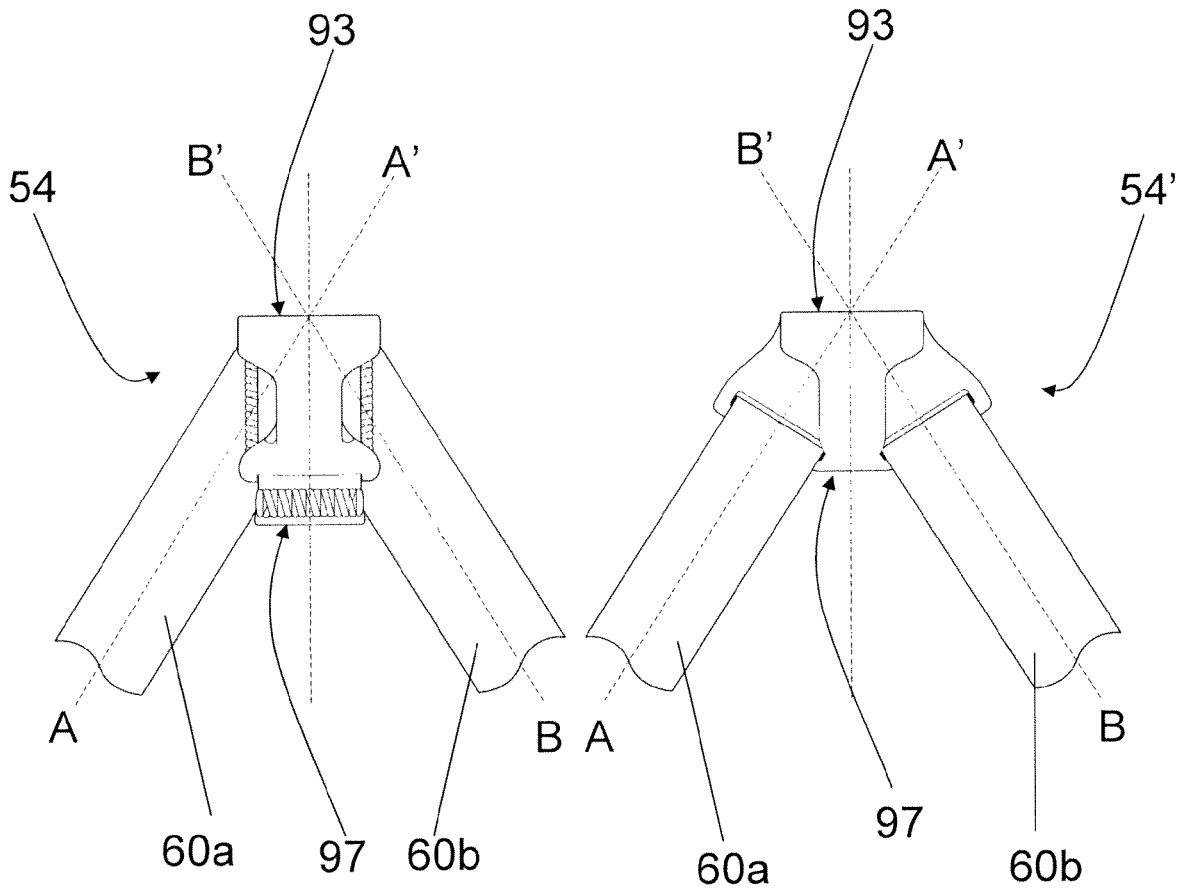
FIG. 5 shows the two embodiments of the female component of the buckle taken from FIG. 1 and FIG. 4 to illustrate the critical geometry of the present invention.

FIG. 5 shows how both female components 54 and 54' share the critical geometry that allows tension to pass through the buckle without being dissipated by intervening linear space. The dotted lines A-A' and B-B' follow the tension in the flexible straps 60*a*, 60*b* respectively. The slots 95*a*, 95*b* are angled toward each other so that the lines of tension A-A' and B-B' intersect each other at or very near the front surface 93 of the female component. As can be seen in FIG. 5, both embodiments 54 and 54' of the female component provide this geometry. When the male and female components are engaged, these lines of tension are substantially continuous—that is, the lines A-A' and B-B' shown in FIG. 5 are substantially congruent with complementary lines from the V-shaped strap of the male component. This is because when the male and female portions of the buckle are locked, the V-shaped straps come together to form the letter "X," so that tension in the opposed straps are aligned. This has been found to substantially improve helmet stability.

Figure 6:
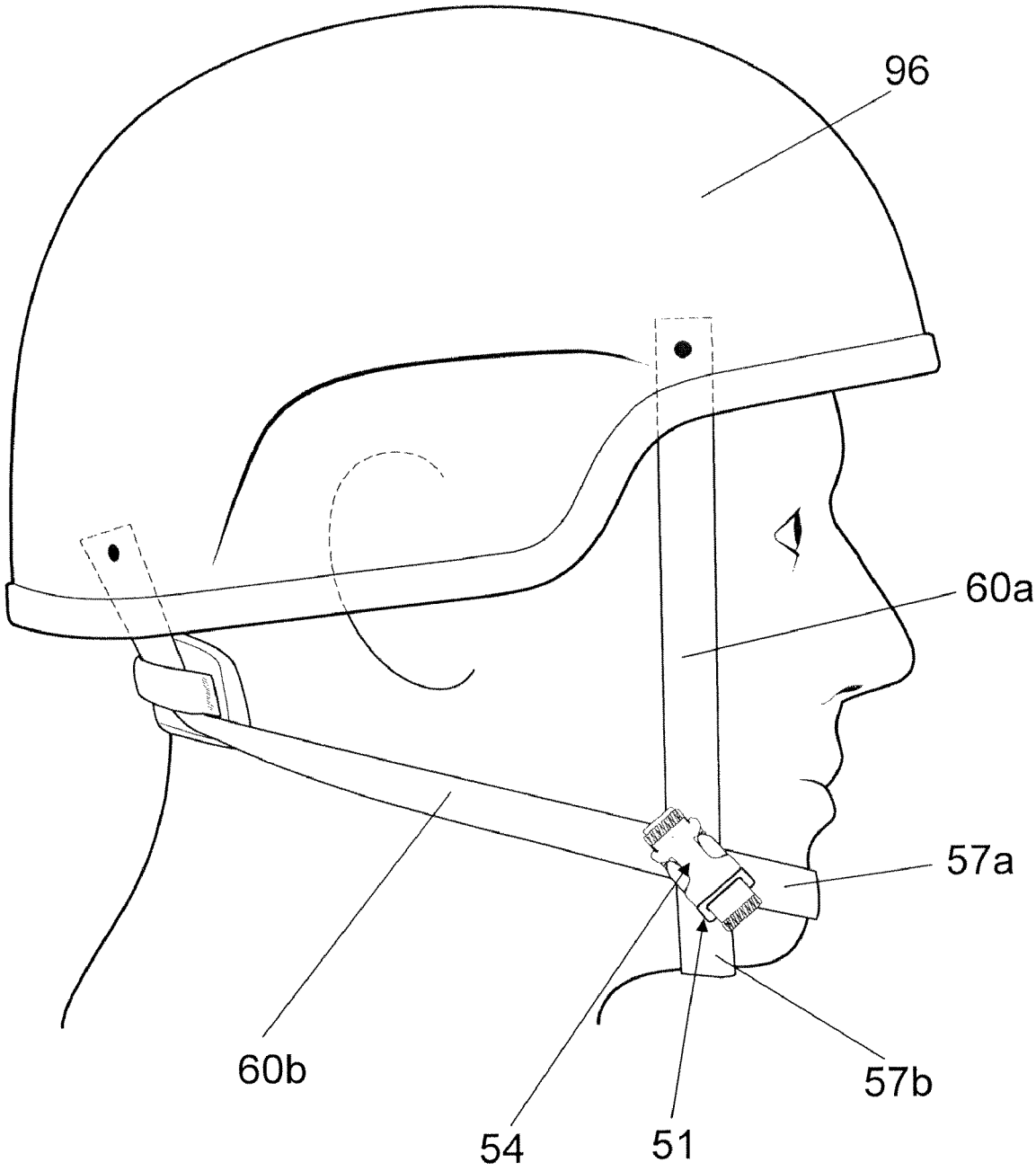
FIG. 6 is a side view of a protective helmet with straps connected at the chin using a buckle constructed according to the present invention.

FIG. 6 shows a system of helmet straps employing the buckle of the present invention to secure a protective helmet 96. A chin-holding component comprises the strap segment 57*a*, which passes between the chin and the lower lip, and the strap segment 57*b*, which passes below the chin and is joined to the male component 51 of the buckle. The retention strap segment 60*a* is connected to the side of helmet toward the front, and the strap segment 60*b* is connected to the side of the helmet toward the rear. These are joined, as described above, to the female component 54 of the buckle. When the male component 51 is inserted into the female component 54, the strap segments 57*a*, 57*b* and 60*a*, 60*b* abut to form the letter "X" because the buckle does not occupy significant space between them. The result is improved stability of the helmet 96 with respect to the wearer's head.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

The invention claimed is:

1. A mounting buckle for a safety helmet, the buckle comprising first and second mating members each having an abutment surface, joinder of the first and second mating members bringing the abutment surfaces substantially into contact with each other, each of the mating members being configured for attachment to a respective V-shaped strap having an apex edge, each mating member comprising means for affixing the apex edge of an attached V-shaped strap substantially flush with the abutment surface of the mating member such that joinder of the first and second mating members brings the apices of the V-shaped straps substantially into contact with each other.

2. The buckle of claim 1 wherein the first mating member comprises a pair of flexible fingers and the second mating member comprises engagement surfaces whereby, following joinder, the fingers are held within the second mating member by the engagement surfaces.

3. The buckle of claim 2 wherein the second mating member comprises a pair of openings affording access to the fingers of the first mating member when joined to the second mating member, thereby permitting flexure of the fingers and disjoinder of the first and second mating members.

4. A retention system for a helmet, the retention system comprising:

a buckle comprising first and second mating members each having an abutment surface, joinder of the first and second mating members bringing the abutment surfaces substantially into contact with each other; and first and second straps attached, respectively, to the first and second mating members, each of the straps being V-shaped and having an apex edge, the apex edge being substantially flush with the abutment surface of the mating member to which it is attached such that joinder of the first and second mating members brings the apices of the V-shaped straps substantially into contact with each other.

5. The retention system of claim 4 wherein the first mating member comprises a pair of flexible fingers and the second mating member comprises engagement surfaces whereby, following joinder, the fingers are held within the second mating member by the engagement surfaces.

6. The retention system of claim 5 wherein the second mating member comprises a pair of openings affording access to the fingers of the first mating member when joined to the second mating member, thereby permitting flexure of the fingers and disjoinder of the first and second mating members.

7. A helmet comprising:

a shell;

a buckle comprising first and second mating members each having an abutment surface, joinder of the first and second mating members bringing the abutment surfaces substantially into contact with each other; and first and second straps each attached to the helmet shell and having a V-shaped portion, the V-shaped portions being attached, respectively, to the first and second mating members, an apex edge of each of the V-shaped portions being substantially flush with the abutment surface of the mating member to which it is attached such that joinder of the first and second mating members brings the apices of the first and second straps substantially into contact with each other.

8. The helmet of claim 7 wherein each of the straps has two free ends, one free end being attached to a forward portion of the helmet and the other free end being attached to a rearward portion of the helmet.

9. The helmet of claim 7, wherein at least one of the first and second straps comprises a chin-holding component.

10. The helmet of claim 9, wherein the chin-holding component comprises a first strap segment for passing below a chin of a wearer and a second chin-holding component for passing between the chin and a lower lip of a wearer.

* * * * *